US005411615A

United States Patent [19]

Sumrail et al.

[11] Patent Number: 5,411,615

[45] Date of Patent: May 2, 1995

[54] ALUMINIZED EUTECTIC BONDED INSENSITIVE HIGH EXPLOSIVE

[75] Inventors: Theodore S. Sumrail; William H. Graham, both of Huntsville, Ala.; Carl M. Rector, Elora, Tenn.; Joey M. Reed, Huntsville, Ala.

[73] Assignee: Thiokol Corporation, Ogden, Utah

[21] Appl. No.: 131,139

[22] Filed: Oct. 4, 1993

[51] Int. Cl.[6] ..... C06B 31/32; C06B 29/22

[52] U.S. Cl. ..... 149/47; 149/56; 149/76; 149/78; 149/108.2

[58] Field of Search ..... 149/47, 56, 76, 78, 149/108.2

[56] References Cited

U.S. PATENT DOCUMENTS

| | | | |
|---|---|---|---|
| 1,968,158 | 7/1934 | Naoúm et al. | 52/21 |
| 2,904,420 | 9/1959 | Holker | 52/0.5 |
| 3,160,535 | 12/1964 | Wells | 149/7 |
| 3,676,234 | 7/1972 | Schwoyer | 149/38 |
| 3,996,078 | 12/1976 | Klunsch et al. | 149/2 |
| 4,097,317 | 6/1978 | Schnur et al. | 149/7 |
| 4,110,136 | 8/1978 | Hershkowitz et al. | 149/47 |
| 4,128,443 | 12/1978 | Pawlak et al. | 149/73 X |
| 4,134,780 | 1/1979 | Barnett | 149/40 |
| 4,140,561 | 2/1979 | Keith et al. | 149/76 X |
| 4,353,758 | 10/1982 | Akst et al. | 149/109.6 |
| 4,401,490 | 8/1983 | Alexander | 149/76 X |
| 4,419,155 | 12/1983 | Wagaman et al. | 149/109.6 |
| 4,421,578 | 12/1983 | Voreck, Jr. | 149/2 |
| 4,507,161 | 3/1985 | Sujansky et al. | 149/47 X |
| 4,555,280 | 11/1985 | Levinthal | 149/109.6 |
| 4,701,227 | 10/1987 | Loverro, Jr. | 149/47 |
| 4,948,438 | 8/1990 | Patrick et al. | 149/38 |

FOREIGN PATENT DOCUMENTS 138371 2/1920 United Kingdom .

OTHER PUBLICATIONS

"Thermally Insensitive/High Performance Explosives for Underwater Warhead Application", Morton Thiokol, Inc., Aerospace Group, Huntsville Division, response to BAA, Jan. 19, 1989.

*Primary Examiner*—Peter A. Nelson

*Attorney, Agent, or Firm*—Madson & Metcalf; Ronald L. Lyons

[57] ABSTRACT

An insensitive high explosive is obtained by using a dicyandiamide (DCDA), ammonium nitrate (AN), guanidine nitrate (GN), ethylene diamine dinitrate (EDDN) eutectic melt binder in combination with ammonium perchlorate (AP) oxidizer, fine RDX (1 μm to 10 μm particle size), and aluminum metal as a fuel. The fine RDX particles improve performance, boosterability, and sensitivity. The inclusion of AP greatly improves air blast by adding oxygen to the reaction and insuring complete combustion of the ingredients. The aluminum extends the pressure pulse. The ratio of materials is formulated to obtain the lowest known processing temperature.

20 Claims, No Drawings

ALUMINIZED EUTECTIC BONDED INSENSITIVE HIGH EXPLOSIVE

BACKGROUND OF THE INVENTION

1. Field of the Invention

This invention relates to insensitive high performance explosive compositions. More specifically, the present invention relates to the use of aluminized eutectic bonded explosives for military and commercial explosive applications where high performance and insensitivity are necessary without having to employ exotic and expensive ingredients, many of which have limited current availability.

2. Technology Background

It is a continuing objective in the design and production of explosives to provide explosives which are highly energetic when intentionally initiated, but in which the risk of unintentional detonation is minimized. It is preferable that the mass and confinement effects of the explosive case be negligible on the probability of initiation or the transition from burning to detonation in either transport or storage. It is also preferred that if such explosive is unintentionally initiated it will be incapable of propagating to another explosive. Such explosives are termed insensitive high-explosives (IHE). Standards for IHE are discussed, for example, at pages 3-5 to 3-12 of the July 1984 DoD 6055.9-STD "Ammunition and Explosive Safety Standards" and in draft DoD-STD-2105A of Oct. 18, 1988 "Military Standard Hazard Assessment Tests For Non-Nuclear Ordnance".

Conventional IHE compositions, such as PBXN-109, have comprised a curable elastomeric binder in which particles of high-energy material, particularly explosive particles, oxidizers, and reactive metals, are dispersed throughout the binder. The elastomeric binder has generally been a cured elastomer, such as hydroxy-terminated polybutadienes, polypropylene glycols and the like. More recently, efforts have been made to use thermoplastic resin binders to produce insensitive high-explosives.

Other explosive compositions do not include a curable binder, but are melt cast. Typical melt cast compositions include a high explosive and an energetic or inert meltable material with a relatively low melt temperature. The meltable material acts as a "binder" to the solid explosive. TNT (2,4,6-trinitrotoluene) is a commonly used energetic binder employed in melt cast explosives. Energetic filler materials which have been added to TNT include RDX and HMX. Other energetic binders have been demonstrated based on eutectics of ammonium nitrate, such as ammonium nitrate/nitroguanidine (AN/NQ) eutectic.

M A Cook et al., "The Science of High Explosives," New York, Reinhold, p. 13 (1959) describes an explosive based on the reaction of ammonium nitrate (AN) with calcium cyanamide $CaCN_2$ to produce calcium nitrate (CN) plus ammonia and an "organic substance." Cook et al. reported that the addition of a TNT sensitizer resulted in an explosive with critical diameters on the order of 1.25 inches. Analysis of the "organic substance" shows it to be a combination of dicyandiamide and guanidine nitrate (DCDA+GN). This explosive appears to be very thermally stable in a cook-off type situation, as indicated by differential scanning calorimeter, in that an endothermic reaction occurs, presumably from thermal degradation and ammonia liberation. This could result in an explosive with high cook-off insensitivity, a mandatory requirement of the DoD's insensitive munitions requirements per DoD-STD-2105. Eutectics employing DCDA, AN and GN associated compounds are discussed in the literature. Vogel, F. H. and Sage, S., "Development of Low Melting Ammonium Nitrate Explosive," Picatinny Arsenal, New Jersery, PATR 1431 (July 1944) and Sheeline, R. D., "Development of Low Melting Ammonium Nitrate Explosive, Picatinny Arsenal, New Jersery, PATR 1234 (February 1943).

Picatinny Arsenal Technical Reports (PATR) number 1234 (February 1943) and 1431 (July 1944) document eutectic explosives consisting of AN, sodium nitrate (SN), DCDA and either calcium nitrate (CN) or guanidine nitrate (GN). Addition of tetryl or ammonium picrate (APi) reduced critical diameters and yields satisfactory performance properties according to the documents. Use of DCDA, AN, and GN as the primary eutectic in the aforementioned invention was deemed too hazardous to proceed to large scale operations by virtue of high melting/processing temperatures.

A composition developed by the USAF identified as AFX-400, Parsons, G., "Prequalification of an Insensitive High Explosive (IHE)," Eglin AFB, FL, AD-TR-84-94 (December 1984), consists of a eutectic blend of 46% ethylenediaminedinitrate (EDDN), 46% AN, and 8% KN. This composition had good performance properties but high sensitivity in large diameters, presumably by virtue of the high content of EDDN. The presence of KN retarded the phase change properties of the AN.

It would, therefore, be a substantial advancement in the art to provide a high performance explosive which was also insensitive during storage and transportation, yet have a low enough melting point to permit safe processing at large scales. It would be a further advancement in the art to provide a low-cost, readily available explosive ingredient useful in compositions which are high in performance, low in sensitivity and which may be used in a wide variety of explosive formulations.

Such insensitive high performance explosive compositions are disclosed and claimed herein.

SUMMARY OF THE INVENTION

The invention is directed to the use of a DCDA, AN, GN, and EDDN eutectic melt binder in combination with ammonium perchlorate (AP) oxidizer, fine RDX (1 μm to 10 μm particle size), and Al as a fuel. Ground HMX may also be used in place of RDX as a sensitizer, but since HMX is more expensive than RDX, RDX is currently preferred. Other metal fuels, such as Mg may also be used instead of Al but Al is currently preferred because of its low cost. The fine RDX improves performance and boosterability. Although RDX having a particle size in the range from 1–4 μm achieves the lowest sensitivity, excellent insensitivity can still be achieved with 4–10 μm RDX. The inclusion of AP greatly improves air blast by adding oxygen to the reaction and aiding combustion of the ingredients. The Al extends the pressure pulse. The ratio of materials is formulated to obtain the lowest known processing temperature.

The composition is manufactured by adding the DCDA, AN, GN, and EDDN to a mixer, such as a Baker-Perkins mixer. The material is blended dry; however, if residual eutectic is left in the bowl, a rapid melt forms when heated. At a DCDA/AN/GN (DAG) ratio of 30/54/16 a melt occurs at about 180° F. A ratio of 30/54/16 gives the lowest melting point, but other ingredient ranges may be used. For instance, the DCDA may range from 25% to 30%, the AN may range from 50% to 55%, and the GN may range from 15% to 20%. Addition of 20% to 65% EDDN to DAG lowers the melting point further. However, limiting the total EDDN content is crucial to insensitivity.

After the melt is formed, AP is added, then Al then RDX. The material is thoroughly blended and then cast. The material begins to solidify upon cooling, usually below about 185° F. Importantly, because of the lower processing temperature, AP may be safely included in the explosive composition.

The aluminized eutectic bonded explosives of the present invention have several important advantages. For instance, sensitivity to shock is significantly below that of the standard bomb fill explosives such as H-6 or Tritonal, yet the performance has been measured to be very close to H-6. A high content of coolants (DCDA and GN) helps insure a mild cook-off reaction. All ingredients are immediately available or easily manufactured, such that the overall cost is low and end-item production could begin immediately in large quantities. Processing can be accomplished in standard TNT melt cast type equipment with vacuum mixing capability. The explosive does not rely on a "cure reaction" and can be melted or remelted at will. The explosive binder is soluble in water, eliminating the need for hazardous solvents and permitting the easy recovery of the insoluble ingredients such as RDX. Finally, thermal shrinkage is much lower than TNT based explosives.

DETAILED DESCRIPTION OF THE INVENTION

The present invention is directed to insensitive high explosive compositions which use a DCDA, AN, GN, and EDDN eutectic melt binder in combination with AP, fine RDX (1 μm to 10 μm particle size), and Al as a fuel. The eutectic material acts as a "binder" to the solid AP, RDX, and Al.

Although one might expect very fine RDX (1 μm to 10 μm particle size) to render the explosive more sensitive, it has been found that fine RDX actually increases performance with only a marginal increase in sensitivity. The unique eutectic used in the present invention permits low temperature processing such that AP may be safely included in the explosive composition. The inclusion of AP greatly improves air blast by adding oxygen to the reaction and aiding combustion of the ingredients. Adding Al to the explosive extends the pressure pulse.

The composition is manufactured by blending the dry eutectic ingredients (DCDA, AN, GN, and EDDN), and then heating to the melting point, about 185° F. Addition of the dry ingredients to a small amount of preexisting melt facilitates processing. After the melt is formed, AP is added, then Al then RDX. The material is thoroughly blended and then cast using conventional melt cast equipment. The explosive solidifies upon cooling to a temperature below 185° F.

The following examples are offered to further illustrate the present invention. These examples are intended to be purely exemplary and should not be viewed as a limitation on any claimed embodiment.

EXAMPLE 1

An insensitive aluminized eutectic high explosive was manufactured by combining the following ingredients:

| Ingredient | Weight Percent |
|---|---|
| DCDA | 10.8 |
| AN | 19.44 |
| GN | 5.76 |
| EDDN | 15.0 |
| AP | 20.0 |
| Al (17 μm) | 17.0 |
| RDX (4 μm) | 12.0 |

The DCDA, AN, GN, and EDDN were placed into a Baker-Perkins mixer at ≈190° F. The material was blended dry and the mixer turned off while maintaining the high temperature. The mixture melted at ≈185° F. After the melt was formed, the AP was added, then the Al and then the RDX. The explosive composition was thoroughly blended and then cast. Upon cooling to a temperature below 185° F., the material began to solidify.

EXAMPLE 2

Card gap testing of the explosive composition of Example 1 was conducted. In the standard "card gap" test, an explosive booster is set off a certain distance from the explosive. The space between the booster and the explosive charge is filled with an inert material such as PMMA (polymethylmethacrylate). The distance is expressed in cards, where 1 card is equal to 0.01 inch such that 70 cards is equal to 0.7 inches. If the explosive does not detonate at 70 cards, for example, then the explosive is insensitive at 70 cards.

The pipes were instrumented for detonation velocity. Two tests were conducted for boosterability/sensitivity of the explosive composition, the first test at zero cards and the second at 70 cards. Detonation occurred at zero cards, while no detonation occurred at 70 cards. These results suggest that the aluminized eutectic binder provides a low sensitivity explosive composition while permitting boostering at low diameters.

EXAMPLE 3

An insensitive eutectic high explosive was manufactured by combining the following ingredients:

| Ingredient | Weight Percent |
|---|---|
| DCDA | 17.5 |
| AN | 31.3 |
| GN | 9.2 |
| EDDN | 15.0 |
| RDX (1–4 μm) | 22.0 |
| KN | 5.0 |

The DCDA, AN, GN, and EDDN were placed into a Baker-Perkins mixer at ≈190° F. The material was blended dry and the mixer turned off. The mixture melted at ≈185° F. After the melt was formed, the RDX and KN was added. KN was added as a phase stabilizer for AN. The explosive composition was thoroughly blended and then cast. Upon cooling to a temperature below 185° F., the material began to solidify. The resulting explosive composition is intended to be a replacement for TNT or Composition B-type explosives which are commonly used in artillery rounds.

EXAMPLE 4

An insensitive aluminized eutectic high explosive was manufactured by combining the following ingredients:

| Ingredient | Weight Percent |
|---|---|
| DCDA | 7.7 |
| AN | 14.812 |
| GN | 5.488 |
| AP | 7.0 |
| Al (17 μm) | 20.0 |
| RDX (4 μm) | 20.0 |
| TNT | 25.0 |

The DCDA, AN, and GN were placed into a Baker-Perkins mixer at a temperature of about 190° F. The material was blended dry and the mixer turned off. The mixture melted at about 185° F. After the melt was formed, the AP, the Al the RDX, and the TNT were added. The explosive composition was thoroughly blended and then cast. Upon cooling to a temperature below 185° F., the material began to solidify.

EXAMPLE 5

A eutectic binder for use in an insensitive high explosive is prepared by adding AN to a ternary eutectic combination of 27.5% DCDA, 52.9% AN, and 19.6% GN. This DCDA/AN/GN eutectic had a melting point of about 214° F. Upon addition of 5% to 10% AP, the melting point dropped from 214° F. to 194° F. to 203° F. Upon addition of more AP, the melting point remained stable around 203° F. over the range from about 10% AP to 66.7% AP.

From the foregoing it will be appreciated that the present invention provides high performance explosives which are also insensitive during storage and transportation. The present invention further provides a new major explosive ingredient which may be used in a variety of explosive formulations for use in high performance, low sensitivity explosive applications.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An insensitive high performance explosive composition comprising:

a eutectic melt comprising dicyandiamide (DCDA), ammonium nitrate (AN), guanidine nitrate (GN), ethylene diamine dinitrate (EDDN);

1,3,5-trinitro-1,3,5-triaza-cyclohexane (RDX) having a particle size in the range from about 1 μm to about 10 μm;

ammonium perchlorate (AP); and a reactive metal.

2. An insensitive high performance explosive composition as defined in claim 1, wherein the reactive metal is aluminum, magnesium, boron, titanium, zirconium, or mixtures thereof.

3. An insensitive high performance explosive composition as defined in claim 1, wherein the reactive metal is aluminum.

4. An insensitive high performance explosive composition as defined in claim 1, further comprising an AN phase stabilizing material.

5. An insensitive high performance explosive composition as defined in claim 4, wherein the AN phase stabilizing material is potassium nitrate (KN).

6. An insensitive high performance explosive composition as defined in claim 4, wherein the AN phase stabilizing material is zinc.

7. An insensitive high performance explosive composition as defined in claim 1, wherein the DCDA, AN, and GN forming the eutectic melt are present in the following weight ratio: 25% to 30% DCDA, 50% to 55% AN, and 15% to 20% GN.

8. An insensitive high performance explosive composition as defined in claim 1, wherein the DCDA, AN, GN, and EDDN forming the eutectic melt are present in the following weight ratio: 20% to 25% DCDA, 35% to 40% AN, 10% to 15% GN, and 25% to 30% EDDN.

9. An insensitive high performance explosive composition as defined in claim 1, wherein the ammonium perchlorate is present in the explosive composition in the range from about 10% to about 60%, by weight.

10. An insensitive high performance explosive composition as defined in claim 1, wherein the ammonium perchlorate is present in the explosive composition in the range from about 10% to about 30%, by weight.

11. An insensitive high performance explosive composition as defined in claim 1, wherein the reactive metal is present in the explosive composition in the range from about 10% to about 45%, by weight.

12. An insensitive high performance explosive composition as defined in claim 1, wherein the reactive metal is present in the explosive composition in the range from about 15% to about 25%, by weight.

13. An insensitive high performance explosive composition as defined in claim 1, wherein the reactive metal has a particle size in the range from 5 μm to about 50 μm.

14. An insensitive high performance explosive composition as defined in claim 1, wherein the reactive metal has a particle size in the range from 15 μm to about 20 μm.

15. An insensitive high performance explosive composition as defined in claim 1, wherein the RDX is present in the explosive composition in the range from about 10% to about 40%, by weight.

16. An insensitive high performance explosive composition as defined in claim 1, wherein the RDX is present in the explosive composition in the range from about 10% to about 20%.

17. An insensitive high performance explosive composition as defined in claim 1, wherein the eutectic melt represents from about 20% to about 50% of the explosive composition.

18. An insensitive high performance explosive composition as defined in claim 1, wherein the RDX particle size is in the range from about 1 μm to about 4 μm.

19. An insensitive high performance explosive composition comprising:

a eutectic melt comprising dicyandiamide (DCDA), ammonium nitrate (AN), guanidine nitrate (GN), ethylene diamine dinitrate (EDDN), wherein the DCDA, AN, GN, and EDDN forming the eutectic melt are present in the following weight ratio: 20% to 25% DCDA, 35% to 40% AN, 10% to 15% GN, and 25% to 30% EDDN, and wherein the eutectic melt represents from about 20% to about 50% of the explosive composition;

1,3,5-trinitro-1,3,5-triaza-cyclohexane (RDX) having a particle size in the range from about 1 μm to about 10 μm;

ammonium perchlorate (AP) present in the explosive composition in the range from about 10% to about 60%, by weight; and aluminum present in the explosive composition in the range from about 10% to about 45%, by weight.

20. An insensitive high performance explosive composition as defined in claim 19, wherein the RDX particle size is in the range from about 1 μm to about 4 μm.

* * * * *

UNITED STATES PATENT AND TRADEMARK OFFICE
CERTIFICATE OF CORRECTION

PATENT NO. : 5,411,615

DATED : May 2, 1995

INVENTOR(S) : Theodore S. Sumrall; William H. Graham; Carl M. Rector; Joey M. Reed

It is certified that error appears in the above-identified patent and that said Letters Patent is hereby corrected as shown below:

On the title page items [19] and [75]

The name of inventor Theodore S. Sumrall was published as:

Theodore S. Sumrail;

The correct spelling of his name is:

Theodore S. Sumrall.

Signed and Sealed this

Twenty-fourth Day of September, 1996

*Attest:*

Bruce Lehman

BRUCE LEHMAN

*Attesting Officer*

*Commissioner of Patents and Trademarks*